US008010288B2

(12) United States Patent
Bouchet et al.

(10) Patent No.: US 8,010,288 B2
(45) Date of Patent: Aug. 30, 2011

(54) AIRCRAFT TERRAIN AVOIDANCE AND ALARM METHOD AND DEVICE

(75) Inventors: Christophe Bouchet, Toulouse (FR); Jean-Pierre Demortier, Maurens (FR)

(73) Assignee: Airbus France, Toulouse (FR)

( * ) Notice: Subject to any disclaimer, the term of this patent is extended or adjusted under 35 U.S.C. 154(b) by 1145 days.

(21) Appl. No.: 11/719,134

(22) PCT Filed: Nov. 10, 2005

(86) PCT No.: PCT/FR2005/002803

§ 371 (c)(1),
(2), (4) Date: May 11, 2007

(87) PCT Pub. No.: WO2006/051220

PCT Pub. Date: May 18, 2006

(65) Prior Publication Data

US 2009/0076728 A1 Mar. 19, 2009

(30) Foreign Application Priority Data

Nov. 15, 2004 (FR) ..... 04 12067

(51) Int. Cl.
*G08G 11/16* (2006.01)

(52) U.S. Cl. ..... 701/301; 701/300; 342/29; 340/961; 340/974

(58) Field of Classification Search ..... 701/3–5, 701/16–17, 9, 14, 300–301; 340/29, 945, 340/961–963, 979, 967, 9; 240/186, 188; 342/455, 29; 244/158–173.3, 75–99.9
See application file for complete search history.

(56) References Cited

U.S. PATENT DOCUMENTS 3,752,967 A * 8/1973 Vietor ..... 701/15
(Continued)

FOREIGN PATENT DOCUMENTS

EP 0750238 12/1996
(Continued)

OTHER PUBLICATIONS

A multimodal MAV for situational awareness in near-earth environments; Green, W.E. et al.; Intelligent Robots and Systems, 2007. IROS 2007. IEEE/RSJ International Conference on; Digital Object Identifier: 10.1109/IROS.2007.4399572 Publication Year: 2007 , pp. 2549-2550.*

(Continued)

*Primary Examiner* — Cuong H Nguyen
(74) *Attorney, Agent, or Firm* — Dickinson Wright PLLC

(57) ABSTRACT

An aircraft terrain avoidance system include a device having a first unit knowing a profile of the terrain that is located at the front of the aircraft, a second unit for determining an avoidance trajectory, a third unit which is connected to the first and second units and used to verify if there is a terrain collision risk for the aircraft, a fourth unit for emitting an alarm signal in the event of detection of a collision risk by the third unit, at least one aircraft performance database relating to an avoidance maneuvering gradient which can be flown by the aircraft according to particular flight parameters, and a fifth unit for determining the effective values of the particular parameters during the flight of the aircraft. The third unit is formed such that it is possible to determine the avoidance trajectory according to information received from the database and the fifth unit.

10 Claims, 2 Drawing Sheets

U.S. PATENT DOCUMENTS

| | | | | |
|---|---|---|---|---|
| 4,675,823 | A * | 6/1987 | Noland | 701/300 |
| 4,924,401 | A * | 5/1990 | Bice et al. | 701/6 |
| 5,608,392 | A * | 3/1997 | Faivre et al. | 340/967 |
| 5,839,080 | A * | 11/1998 | Muller et al. | 701/9 |
| 5,892,416 | A * | 4/1999 | Unami et al. | 333/187 |
| 5,892,462 | A * | 4/1999 | Tran | 340/961 |
| 6,038,498 | A * | 3/2000 | Briffe et al. | 701/3 |
| 6,057,786 | A * | 5/2000 | Briffe et al. | 340/975 |
| 6,088,654 | A | 7/2000 | Lepere et al. | |
| 6,122,570 | A * | 9/2000 | Muller et al. | 701/9 |
| 6,138,060 | A * | 10/2000 | Conner et al. | 701/9 |
| 6,163,744 | A | 12/2000 | Onken et al. | |
| 6,219,592 | B1 * | 4/2001 | Muller et al. | 701/9 |
| 6,292,721 | B1 * | 9/2001 | Conner et al. | 701/9 |
| 6,347,263 | B1 * | 2/2002 | Johnson et al. | 701/14 |
| 6,606,034 | B1 * | 8/2003 | Muller et al. | 340/970 |
| 6,691,004 | B2 * | 2/2004 | Johnson et al. | 701/14 |
| 6,710,723 | B2 * | 3/2004 | Muller et al. | 340/970 |
| 6,983,206 | B2 * | 1/2006 | Conner et al. | 701/301 |
| 7,064,680 | B2 * | 6/2006 | Reynolds et al. | 340/961 |
| 7,079,951 | B2 * | 7/2006 | Conner et al. | 701/301 |
| 7,089,090 | B2 * | 8/2006 | Artini et al. | 701/3 |
| 7,206,698 | B2 * | 4/2007 | Conner et al. | 701/301 |
| 7,363,145 | B2 * | 4/2008 | Conner et al. | 701/120 |
| 7,493,197 | B2 * | 2/2009 | Bitar et al. | 701/14 |
| 7,570,177 | B2 * | 8/2009 | Reynolds et al. | 340/961 |
| 7,587,278 | B2 * | 9/2009 | Poe et al. | 701/301 |
| 7,702,461 | B2 * | 4/2010 | Conner et al. | 701/301 |
| 7,772,994 | B2 * | 8/2010 | He | 340/976 |
| 2004/0030465 | A1 * | 2/2004 | Conner et al. | 701/16 |
| 2005/0273221 | A1 * | 12/2005 | Artini et al. | 701/3 |
| 2006/0097895 | A1 * | 5/2006 | Reynolds et al. | 340/961 |
| 2006/0290531 | A1 * | 12/2006 | Reynolds et al. | 340/961 |
| 2008/0169941 | A1 * | 7/2008 | He | 340/971 |
| 2010/0042273 | A1 * | 2/2010 | Meunier et al. | 701/9 |
| 2010/0125381 | A1 * | 5/2010 | Botargues et al. | 701/9 |

FOREIGN PATENT DOCUMENTS

| | | | |
|---|---|---|---|
| EP | 0928952 | | 7/1999 |
| EP | 1318492 | | 6/2003 |
| EP | 1859428 | B1 * | 1/2010 |
| EP | 1783572 | B1 * | 4/2010 |
| EP | 1944580 | B1 * | 7/2010 |
| FR | 2905756 | A1 * | 3/2008 |
| FR | 2938683 | A1 * | 5/2010 |
| WO | WO 2006097592 | A1 * | 9/2006 |

OTHER PUBLICATIONS

A real-time optimized path planning for a fixed wing vehicle flying in a dynamic and uncertain environment; Jian Yang et al.; Advanced Robotics, 2005. ICAR '05. Proceedings., 12th International Conference on; Digital Object Identifier: 10.1109/ICAR.2005.1507397; Publication Year: 2005 , pp. 96-102.*

Implementation of collision avoidance system using TCAS II to UAVs; Hyeon-Cheol Lee; Digital Avionics Systems Conference, 2005. DASC 2005. The 24th; vol. 2; Digital Object Identifier: 10.1109/DASC.2005.1563410; Publication Year: 2005.*

A novel algorithm for collision avoidance in commercial aircraft using neural networks and non-linear programming; Christodoulou, M.A.; et al.; Control and Automation, 2008 16th Mediterranean Conference on; Digital Object Identifier: 10.1109/MED.2008.4601988; Publication Year: 2008 , pp. 15-22.*

A novel 3D analytical algorithm for autonomous collision avoidance considering cylindrical safety bubble; Luongo, S. et al.; Aerospace Conference, 2010 IEEE; Digital Object Identifier: 10.1109/AERO.2010.5446780; Publication Year: 2010 , pp. 1-13.*

Performance simulation of radar sensor based obstacle detection and collision avoidance for smart UAV; Kwang, Y.K. et al.; Digital Avionics Systems Conference, 2005. DASC 2005. The 24th; vol. 2; Digital Object Identifier: 10.1109/DASC.2005.1563413; Publication Year: 2005.*

A survey of collision avoidance approaches for unmanned aerial vehicles; Albaker, B.M. et al.; Technical Postgraduates (TECHPOS), 2009 International Conference for; Digital Object Identifier: 10.1109/TECHPOS.2009.5412074; Publication Year: 2009 , pp. 1-7.*

Collision avoidance for airport traffic concept evaluation; Jones, D.R. et al.; Digital Avionics Systems Conference, 2009. DASC '09. IEEE/AIAA 28th; Digital Object Identifier: 10.1109/DASC.2009.5347489; Publication Year: 2009 , pp. 4.C.4-1-4.C.4-15.*

"Terrain Databases and Their Use in Navigation and Collision Avoidance—An Introductory Overview"; Goddard, K.F.; Terrain Databases and Their Use in Navigation and Collision Avoidance, IEE Colloquium on Publication Year: 1995.*

The Application of Oct-trees to Real-time Mission Management; Allerton, D.J.; Terrain Databases and Their Use in Navigation and Collision Avoidance, IEE Colloquium on IET Conferences ; Publication Year: 1995.*

The F-16 Digital Terrain System; Terrain Databases and Their Use in Navigation and Collision Avoidance, IEE Colloquium on IET Conferences; Publication Year: 1995.*

All terrain ground collision avoidance and maneuvering terrain following for automated low level night attack; Barfield, A.F.; Probert, J.; Browning, D.; Aerospace and Electronic Systems Magazine, IEEE; vol. 8 , Issue: 3; Digital Object Identifier: 10.1109/62.199820; Publication Year: 1993 , pp. 40-47.*

Electronic chart based ocean environment development method and its application in digital AUV platform; Jian Liu; Kaizhou Liu; Xisheng Feng; Underwater Technology, 2004. UT '04. 2004 International Symposium on; Digital Object Identifier: 10.1109/UT.2004.1405637; Publication Year: 2004 , pp. 423-429.*

Digital terrain systems; Fountain, J.R.; Airborne Navigation Systems Workshop (Digest No. 1997/169), IEE Colloquium on ; Digital Object Identifier: 10.1049/ic:19970909; Publication Year: 1997 , pp. 4/1-4/6.*

Vision based Hazard detection and obstacle Avoidance for planetary landing; Mahmood, W.; Shah, S.; Nonlinear Dynamics and Synchronization, 2009. INDS '09. 2nd International Workshop on; Publication Year: 2009 , pp. 175-181.*

Obstacle—slope avoidance and velocity control of wheeled mobile robots using fuzzy reasoning; Mester, Gyula; Intelligent Engineering Systems, 2009. INES 2009. International Conference on; Digital Object Identifier: 10.1109/INES.2009.4924770; Publication Year: 2009 , pp. 245-249.*

PCT International Search Report dated Feb. 20, 2006 with English translation.

* cited by examiner

AIRCRAFT TERRAIN AVOIDANCE AND ALARM METHOD AND DEVICE

TECHNICAL FIELD OF THE INVENTION

The present invention relates to an aircraft terrain avoidance and alarm method and device, in particular for a transport plane.

BACKGROUND OF THE INVENTION

It is known that such a device, for example of TAWS type ("Terrain Avoidance and Warning System") or of GPWS type ("Ground Proximity Warning System") is aimed at detecting any risk of collision of the aircraft with the surrounding terrain and at warning the crew when such a risk is detected, so that the latter can then implement a terrain avoidance maneuver. Such a device generally comprises:

- a first means knowing the profile of the terrain at least in front of the aircraft;
- a second means for determining an avoidance trajectory of the aircraft;
- a third means connected to said first and second means, for verifying whether there exists a risk of collision of the terrain for the aircraft; and
- a fourth means for issuing an alarm signal, in case of detection of a risk of collision by said third means.

Generally, said second means determines the avoidance trajectory (which is taken into account by the third means so as to detect a risk of collision with the terrain), by using a slope exhibiting a fixed and invariable value, in general 6° for a transport plane, regardless of the type of aircraft and regardless of its actual performance.

Of course, such a mode of calculation exhibits the risk of underestimating or overestimating the actual performance of the aircraft, this possibly causing overly late detections of risks of collision or false alarms. This mode of calculation is therefore not completely reliable.

Document EP-0 750 238 discloses a terrain avoidance device of the aforesaid type. This known device makes provision to determine two trajectories which are subsequently compared with the profile of the terrain overflown, one of said trajectories representing the predicted effective trajectory of the aircraft and the other trajectory possibly corresponding in particular to a predicted climb trajectory. This prior document makes provision to take account of maneuvering capabilities of the aircraft to predict these trajectories, without however indicating the way in which these trajectories are actually calculated or predicted.

SUMMARY OF THE INVENTION

The present invention relates to a aircraft terrain avoidance and alarm method, which makes it possible to remedy the aforesaid drawbacks.

For this purpose, according to the invention, said method is noteworthy in that:

I) in a preliminary step, at least one database of performance of the aircraft is formed, which performance relates to an avoidance maneuver slope flyable by the aircraft, as a function of particular flight parameters; and II) in the course of a subsequent flight of the aircraft:

a) the effective values of said particular flight parameters are determined;

b) an avoidance trajectory is determined on the basis of these effective values of said particular flight parameters and of said database;

c) with the aid of said avoidance trajectory and of the profile of the terrain situated at least in front of the aircraft, a check is made to verify whether there is a risk of collision with said terrain for said aircraft; and d) in case of risk of collision, a corresponding alarm signal is issued.

Thus, by virtue of the invention, instead of using as stated above a fixed and invariant slope value, the avoidance trajectory is determined by taking account of the actual performance of the aircraft, by virtue of the characteristics of said database and by virtue of the measurements of said effective values. Consequently, the detection of a risk of collision with the terrain takes account of the effective capabilities of the aircraft, thereby making it possible in particular to avoid false alarms and to obtain particularly reliable monitoring. It will be noted that document EP-0 750 238 mentioned above does not make provision to determine and to use a slope (for an avoidance trajectory) which depends on the effective values of particular flight parameters.

Advantageously, to form said database, a plurality of values is determined for said slope, which are representative on each occasion of different values as regards said flight parameters. Preferably, said flight parameters comprise at least some of the following parameters of the aircraft:

- its mass;
- its speed;
- its altitude;
- the ambient temperature;
- its centering;
- the position of its main landing gear;
- the aerodynamic configuration;
- the activation of an air-conditioning system;
- the activation of an anti-icing system; and
- a possible failure of an engine.

Furthermore, advantageously, for at least one flight parameter, a predetermined fixed value is used to form said database, thereby making it possible to reduce the size of the database. In this case, preferably, use is made, as predetermined fixed value for a flight parameter, of the value of this flight parameter which exhibits the most unfavorable effect on the slope of the aircraft. By way of example, the centering of the aircraft can be fixed at the front limit value which is the most penalizing.

In a preferred embodiment, use is made, for the speed, of a stabilized minimum speed that is known and that the aircraft normally flies at during a standard terrain avoidance procedure following an alarm of risk of collision, that is to say a fixed value corresponding to a speed-wise protection value for flight controls of the aircraft.

In a variant applied to the monitoring of a low-altitude flight of an aircraft, use is advantageously made, for the speed, of a predetermined value corresponding to a speed of best slope, and not to a minimum speed as in the previous example.

Additionally, to form said database, in case of failure of an engine, the slope of the aircraft is deduced from a minimum slope representative of normal operation (failure-free) of all the engines of the aircraft and to which is applied a deduction dependent on said nominal failure. Preferably, said deduction is calculated by means of a polynomial function modeling said nominal slope (slope of the aircraft with all engines operational).

The present invention also relates to an aircraft terrain avoidance and alarm device, in particular for a transport plane, said device being of the type comprising:

- a first means knowing the profile of the terrain at least in front of the aircraft;

a second means for determining an avoidance trajectory;

a third means connected to said first and second means, for verifying whether there exists a risk of collision of the terrain for the aircraft; and a fourth means for issuing an alarm signal, in case of detection of a risk of collision by said third means.

It is known that generally said second means determines the avoidance trajectory, by calculating an avoidance slope at the current speed of the aircraft, which is greater than a minimum speed that the aircraft normally flies at during a standard terrain avoidance procedure following an alarm. Consequently, this avoidance slope is different from the slope which will actually be flown during the maneuver. Such a mode of calculation can be the cause of erroneous alarms, by initially underestimating the actual performance of the aircraft.

In particular to remedy these drawbacks, said device of the aforesaid type is noteworthy, according to the invention, in that it moreover comprises at least one database of performance of the aircraft, relating to an avoidance maneuver slope flyable by the aircraft, as a function of particular flight parameters, and a fifth means for determining in the course of a flight of the aircraft the effective values of said particular parameters, and in that said second means is formed in such a way as to determine said avoidance trajectory, as a function of cues received respectively from said database and from said fifth means.

The design of said database therefore takes account of a predictive capability as regards the climb performance of the aircraft so as to avoid the terrain. Moreover, the speed of the avoidance phase being predetermined (at a minimum speed, as specified hereinbelow) so as to subsequently provide the associated slope, one thus dispenses with the current speed of the aircraft (which is necessarily greater than said minimum speed), thereby making it possible to stabilize the avoidance slope calculated by the device in accordance with the invention and thus to avoid false alarms.

In a particular embodiment, the device in accordance with the invention comprises a plurality of such databases relating respectively to various categories of aircraft and a means of selection for selecting, from among these databases, the one which relates to the aircraft on which said device is mounted, said second means using cues from the database thus selected to determine said avoidance trajectory.

Each of said categories comprises:

either a single type of aircraft;

or a set of types of aircraft exhibiting for example substantially equivalent performance and grouped together into one and the same category.

BRIEF DESCRIPTION OF THE DRAWINGS

The figures of the appended drawing will elucidate the manner in which the invention may be embodied. In these figures, identical references designate similar elements.

DETAILED DESCRIPTION OF THE INVENTION

Figure 1:
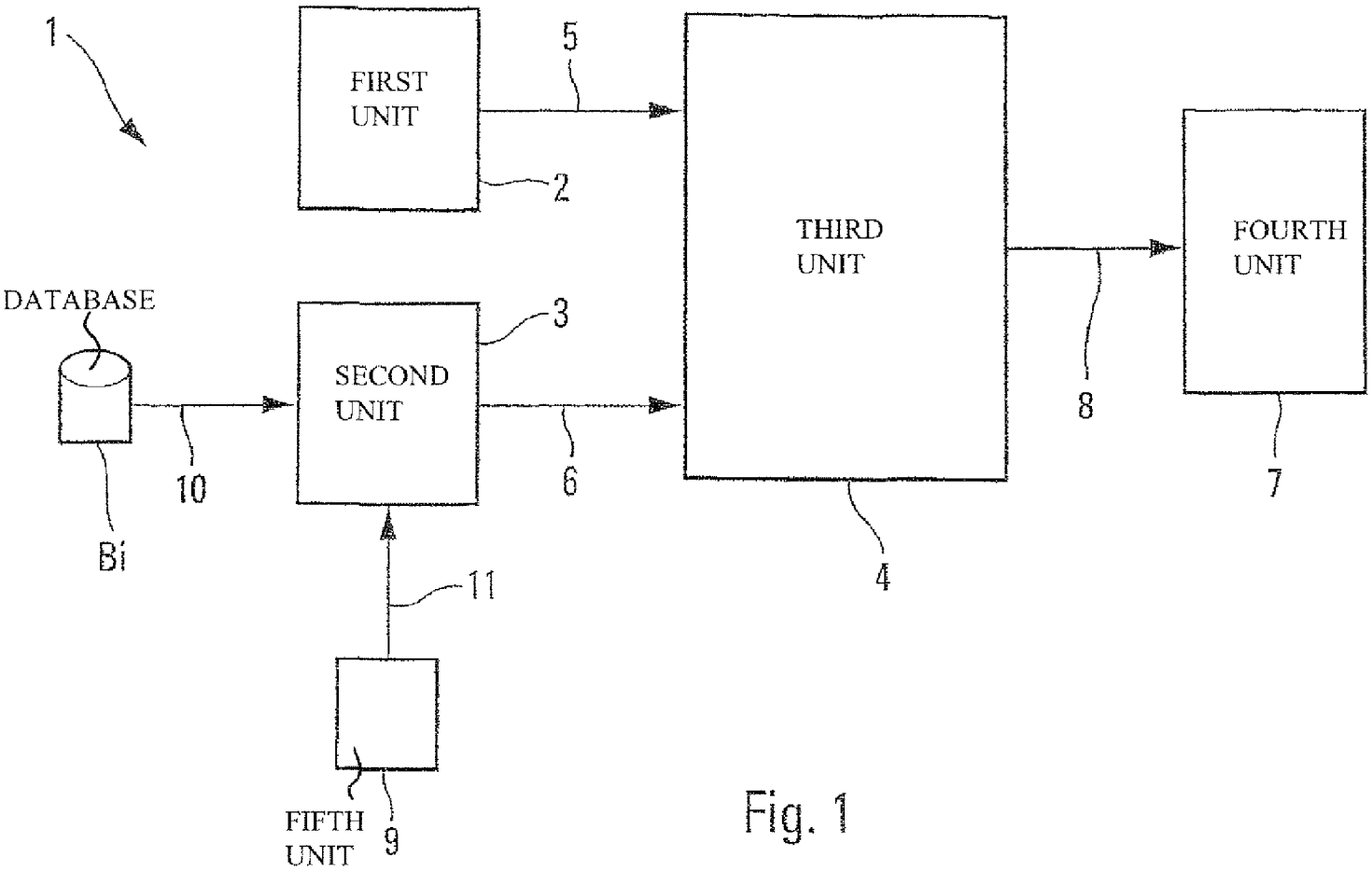
FIGS. 1 and 2 are the schematic diagrams of two different embodiments of a terrain avoidance and alarm device in accordance with the invention.
Figure 2:
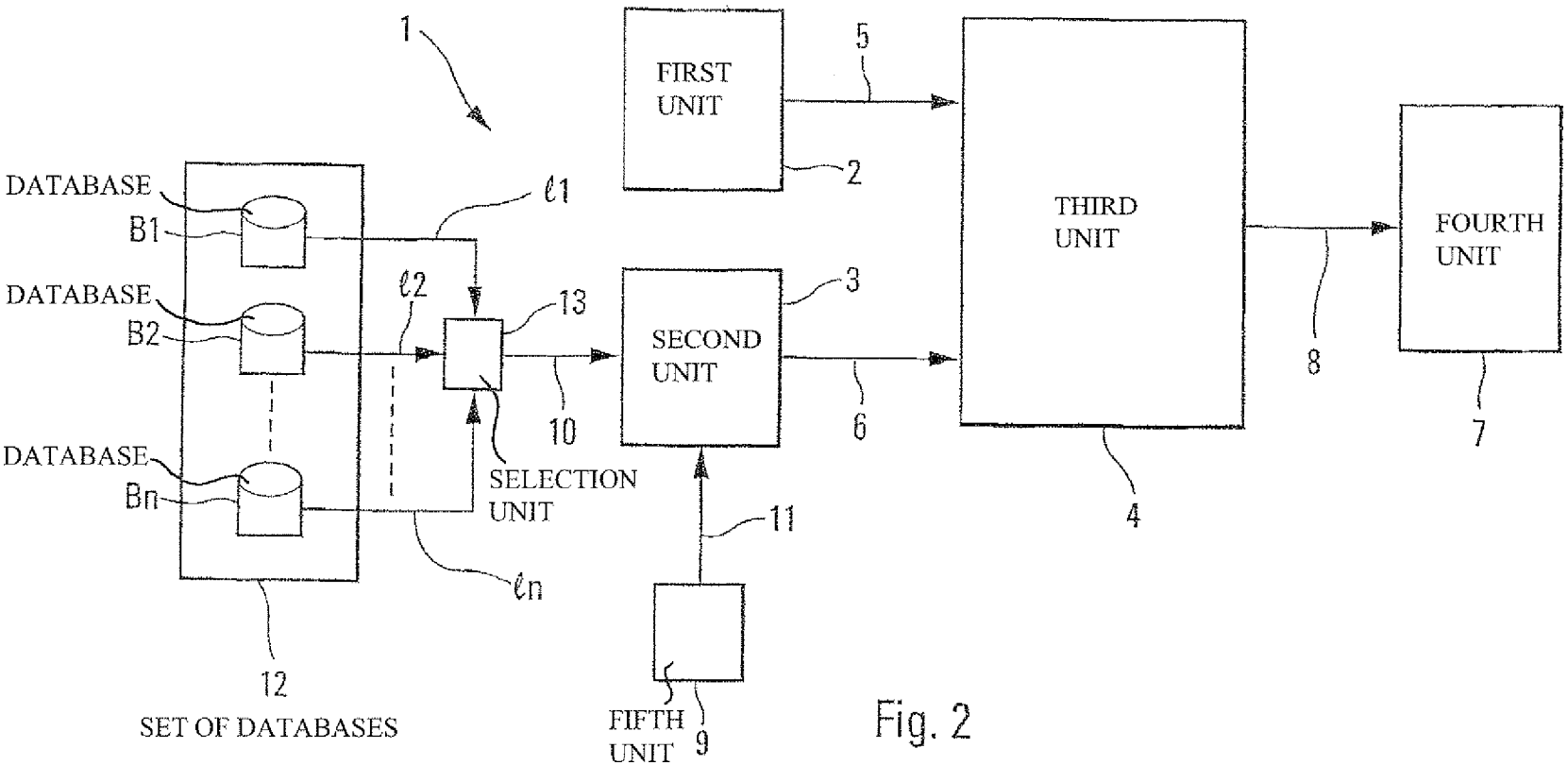

The device 1 in accordance with the invention and represented diagrammatically in FIGS. 1 and 2 is aimed at detecting any risk of collision of an aircraft, in particular a transport plane, with the surrounding terrain and at warning the crew of the aircraft when such a risk is detected, so that the latter can then implement a terrain avoidance maneuver.

Such a device 1, for example of TAWS type ("terrain avoidance and warning system") or of GPWS type "ground proximity warning system"), which is carried onboard the aircraft, comprises in standard fashion:

a means 2 which knows the profile of the terrain at least in front of the aircraft and which for this purpose comprises for example a database of the terrain and/or a means for detecting the terrain such as a radar;

a means 3 for determining an avoidance trajectory;

a means 4, which is connected by way of links 5 and 6 to said means 2 and 3, for verifying in a standard fashion whether there exists a risk of collision of the terrain for the aircraft, on the basis of the cues transmitted by said means 2 and 3; and a means 7 which is connected by way of a link 8 to said means 4, for issuing an alarm signal (audible and/or visual), in case of detection of a risk of collision by said means 4.

According to the invention:

said device 1 furthermore comprises:

at least one database Bi, B1, B2, Bn of performance of the aircraft, which performance relates to an avoidance maneuver slope flyable by the aircraft, as a function of particular flight parameters, as specified hereinbelow; and a means 9 for determining in the course of a flight of the aircraft the effective values of said particular flight parameters; and said means 3 is connected by way of links 10 and 11 respectively to said database Bi, B1, B2, Bn and to said means 9 and is formed in such a way as to determine said avoidance trajectory, as a function of the cues received both from said database Bi, B1, B2, Bn and from said means 9, as specified hereinbelow.

Moreover, according to the invention, said database Bi, B1, B2, Bn is formed on the ground during a preliminary step, before a flight of the aircraft, in the manner specified hereinbelow.

In particular, to form said database Bi, B1, B2, Bn, a plurality of values of said slope is determined, representative respectively of a plurality of different values as regards said flight parameters. These flight parameters comprise parameters relating to flight characteristics (speed, mass, etc.) of the aircraft, parameters relating to systems (air conditioning, anti-icing, etc.) of the aircraft, and parameters relating to the environment (temperature), outside the aircraft. Preferably, said flight parameters comprise at least some of the following parameters relating to the aircraft:

the mass of the aircraft;

the speed of the aircraft;

the altitude of the aircraft;

the ambient temperature;

the centering of the aircraft;

the position of the main landing gear of the aircraft;

the aerodynamic configuration (that is to say the position of slats and flaps on the wings in the case of a plane);

the activation (or nonactivation) of a standard air-conditioning system of the aircraft;

the activation (or nonactivation) of a standard anti-icing system of the aircraft; and a possible failure of an engine of the aircraft.

In a particular embodiment, said slope is calculated in standard fashion, as a function of said flight parameters, on the basis of standard documentation for the performance of the aircraft (for example the flight manual), which arises out of models rejigged through flight trials.

Furthermore, for at least one of the aforesaid flight parameters, a predetermined fixed value is used to form said database Bi, B1, B2, Bn, thereby making it possible to reduce the size of the database Bi, B1, B2, Bn. In this case, preferably, use is made, as predetermined fixed value for a flight parameter, of the value of this flight parameter which exhibits the most unfavorable effect on the slope of the aircraft. By way of example, the centering of the aircraft can be fixed at the front limit value which is the most penalizing, and the air-bleed configurations (anti-icing and air conditioning) may be fixed in such a way as to remain conservative vis-à-vis the performance of the aircraft.

In a preferred embodiment, use is made, for the speed, of a fixed value corresponding to a speed-wise protection value for flight controls of the aircraft, that is to say a minimum speed that the aircraft normally flies at during a standard terrain avoidance maneuver following an alarm, for example a speed Vαmax (speed at maximum angle of incidence) or a speed VSW (of the "stall warning" type). More precisely, it is known that for aircraft, whose flight envelope is protected from stalling by standard computers, a standard avoidance maneuver leads to the aircraft being brought onto a climb slope corresponding to a minimum speed which is maintained by these computers so that the aircraft will not be able to go beyond the angle of incidence corresponding to this minimum speed. It is therefore this climb slope (stabilized) which has been determined initially for all possible conditions defined by the configurations of the aforesaid flight parameters (other than the speed) and has subsequently been modeled in such a way as to be integrated into the database Bi, B1, B2, Bn.

Thus, by virtue of the invention:

- the design of the database Bi, B1, B2, Bn introduces a predictive capability, since the speed of the avoidance phase is predetermined so as to subsequently provide the associated slope. One thus dispenses with the current speed of the aircraft (which is necessarily greater than this minimum speed), thereby making it possible to stabilize the avoidance slope calculated by the device 1. Without this modeling, the device 1 ought to calculate an avoidance slope at the current speed of the aircraft, this avoidance slope would therefore be different from the slope actually flown during the maneuver (and would then tend toward this latter slope, in tandem with the deceleration of the aircraft). This type of calculation could cause erroneous alarms, by initially underestimating the actual performance of the aircraft. The aforesaid modeling in accordance with the present invention therefore makes it possible to provide a calculation slope which is stable for the device 1 (by integrating the speed of calculation of the slope) and thus to avoid false alarms;
- the integration of this parameter (speed) makes it possible to considerably decrease the size of the database Bi, B1, B2, Bn;
- the database Bi, B1, B2, Bn is constructed on regulatory bases (the slopes at minimum speed being certified data), thereby making it possible to be able to readily formulate a process for generating data which complies with a "DO-200A" standard (and which is therefore qualifiable with respect to this standard) guaranteeing the level of integrity of the databases.

It will be noted moreover that a complementary solution of the present invention aims at modeling the maximum slopes flyable with engine failure(s), on the basis of the slope with all engines operational, and the addition of a (negative) slope deduction Δp which is modeled by a polynomial function. This modeling makes it possible to significantly reduce the size of the memory intended to receive the database Bi, B1, B2, Bn (memory size reduced by a coefficient 2 or 3 in principle). This slope deduction Δp can be expressed in the form:

$$\Delta p = K1 \cdot PO + K2$$

in which:

- PO corresponds to the slope with all engines operational; and
- K1 and K2 represent constants which are applicable to a whole family of aircraft of similar geometry.

An extrapolated application of the invention described hereinabove may also be envisaged for a function of monitoring a low-altitude flight of an aircraft. The major difference as compared with the previous description is to do with the fact that the slopes modeled are no longer modeled for minimum speeds, but for slopes at a particular speed that is indicated hereinafter (with the condition: a failed engine). This time the aim of the modeling is to make the flight of the aircraft safe (during low-altitude flight) vis-à-vis an engine failure. Unlike the aforesaid terrain collision avoidance procedure, the procedure applicable in the case of an engine failure (during low-altitude flight) is aimed at bringing the aircraft to a speed of best slope. The expression a speed of best slope is understood to mean the speed which makes it possible to attain a maximum of altitude for a minimum distance, doing so without departing from the speed flight domain. On the other hand, the aforesaid principles remain the same, since the speed of best slope is a speed which is predetermined, as a function of at least some of the aforesaid flight parameters (mass, altitude, etc.).

It will be noted that the performance database Bi, B1, B2, Bn makes it possible to calculate in real time the aircraft's capabilities of avoiding, by going above it, any obstacle which lies ahead of it and/or along the flight plan followed. Thus, the device 1 in accordance with the invention determines the avoidance trajectory by taking account of the effective performance of the aircraft, by virtue of the characteristics of said database Bi, B1, B2, Bn and by virtue of the measurements of said effective values. Consequently, the detection of a risk of collision with the terrain takes account of the effective capabilities of the aircraft, thereby making it possible in particular to avoid false alarms and to obtain particularly reliable monitoring.

In a particular embodiment represented in FIG. 2, the device 1 in accordance with the invention comprises:

- a set 12 of databases B1, B2, . . . , Bn which relate respectively to n different categories of aircraft, n being an integer greater than 1; and
- a means of selection 13 which is connected by links l1, l2 to ln to said databases B1, B2 to Bn respectively and which is intended to select, from among these databases B1, B2 to Bn, the one which relates to the aircraft on which said device 1 is mounted. Said means 3 which is connected by the link 10 to said means of selection 13 uses solely cues from the database selected by said means of selection 13 to determine said avoidance trajectory.

Each of said categories of aircraft comprises either a single type of aircraft (a category then corresponds to a type), or a set of types of aircraft exhibiting for example substantially equivalent performance and grouped together into one and the same category (each category then comprises several types).

Preferably, the selection of the database representative of the aircraft, which is implemented by the means of selection 13, is carried out by a pin programming (that is to say with terminals of a connector between the aircraft and the device 1, corresponding to 0 or 1 logic levels depending on the category of aircraft). This makes it possible to have a single type of equipment (device 1) for all the aircraft of different categories (or types) considered, this equipment thus determining by itself the category of aircraft on which it is installed. This programming may alternatively be carried out in a software manner: the means of selection 13 receives for example through a data link a digital value which depends on the category of aircraft and it makes the selection as a function of this digital value received.

The invention claimed is:

1. An aircraft terrain avoidance and alarm device, said device comprising:

a first unit for determining the profile of the terrain at least in front of the aircraft;

a second unit for determining an avoidance trajectory;

a third unit connected to said first and second units, for verifying whether there exists a risk of collision of the terrain for the aircraft; and a fourth unit for issuing an alarm signal, in case of detection of the risk of collision by said third unit, wherein the device moreover comprises:

at least one database of performance of the aircraft, relating to an avoidance maneuver slope flyable by the aircraft, as a function of particular flight parameters, said database comprising a plurality of values for said slope, that are representative on each occasion of different values of said flight parameters, and;

a fifth unit for determining in the course of a flight of the aircraft effective values of said particular parameters, wherein said second unit is formed in such a way as to determine said avoidance trajectory, as a function of cues received respectively from said database and from said fifth unit.

2. A device as claimed in claim 1, comprising: a plurality of databases relating respectively to various categories of aircraft; and a selection unit for selecting, from among the databases, the database which relates to the aircraft on which said device is mounted, said second unit using cues from the database thus selected to determine said avoidance trajectory.

3. An aircraft terrain avoidance and alarm method, comprising:

forming at least one database of performance data of the aircraft, said performance data relating to an avoidance maneuver slope flyable by the aircraft, as a function of flight parameters, and to form the database, a plurality of values are determined for said slope, representative on each occasion of different values of said flight parameters; and in a course of a subsequent flight of the aircraft:

determining effective values of said flight parameters;

determining an avoidance trajectory based on the effective values of said flight parameters and of said database;

performing a check to verify whether a risk of collision exists with said terrain for said aircraft with aid of said avoidance trajectory and of a profile of the terrain situated at least in front of the aircraft; and issuing a corresponding alarm in case of the risk of collision.

4. The method as claimed in claim 3, wherein said flight parameters comprise at least one of the following parameters of the aircraft:

mass;

speed;

altitude;

ambient temperature;

centering;

position of the aircraft's main landing gear;

aerodynamic configuration;

activation of an air-conditioning system;

activation of an anti-icing system; and a possible failure of an engine.

5. The method as claimed in claim 3, wherein, for at least one of the flight parameters, a predetermined fixed value is used to form said database.

6. The method as claimed in claim 5, wherein as the predetermined fixed value for a flight parameter, the value of the flight parameter which exhibits a most unfavorable effect on the slope of the aircraft is used.

7. The method as claimed in claim 4, wherein a predetermined value corresponding to a stabilized minimum speed that the aircraft normally flies at during a terrain avoidance procedure is used for the speed.

8. The method as claimed in claim 4, wherein a predetermined value corresponding to a speed of best slope is used for the speed.

9. The method as claimed in claim 3, wherein, in case of failure of an engine, the slope of the aircraft is deduced from a nominal slope representative of normal operation of all engines of the aircraft and a deduction dependent on said failure is applied thereto.

10. The method as claimed in claim 9, wherein said deduction is calculated using a polynomial function of said nominal slope.

* * * * *